US006661325B2

(12) United States Patent
Suh et al.

(10) Patent No.: US 6,661,325 B2
(45) Date of Patent: Dec. 9, 2003

(54) SPIRAL INDUCTOR HAVING PARALLEL-BRANCH STRUCTURE

(75) Inventors: Dong-woo Suh, Daejon (KR); Bong-ki Mheen, Daejon (KR); Jin-yeong Kang, Daejon (KR)

(73) Assignee: Electronics and Telecommunications Research Institute, Daejon (KR)

( * ) Notice: Subject to any disclaimer, the term of this patent is extended or adjusted under 35 U.S.C. 154(b) by 13 days.

(21) Appl. No.: 10/033,395

(22) Filed: Dec. 28, 2001

(65) Prior Publication Data

US 2003/0038697 A1 Feb. 27, 2003

(30) Foreign Application Priority Data

Aug. 22, 2001 (KR) ..... 2001-50742

(51) Int. Cl.[7] ..... H01F 5/00

(52) U.S. Cl. ..... 336/200; 336/192; 336/208; 336/232

(58) Field of Search ..... 336/65, 83, 192, 336/199, 200, 206–208, 232

(56) References Cited

U.S. PATENT DOCUMENTS 4,313,152 A * 1/1982 Vranken ..... 336/200

5,545,916 A 8/1996 Koullias ..... 257/531

FOREIGN PATENT DOCUMENTS

KR 2000-0019683 4/2000 ..... H01F/41/00

OTHER PUBLICATIONS

IEEE 1998 Radio Frequency Integrated Circuits Symposium, "A Q–Factor Enhancement Technique for MMIC Inductors", M. Danesh, et al., 4 pages, No month.

* cited by examiner

*Primary Examiner*—Tuyen T. Nguyen
(74) *Attorney, Agent, or Firm*—Blakely, Sokoloff, Taylor & Zafman

(57) ABSTRACT

A spiral inductor having a lower metal line and an upper metal line with an insulating layer interposed therebetween is provided. In the spiral inductor, the lower and upper metal lines are connected to each other through a via contact passing through the insulating layer. The upper metal line spirally turns inward from the periphery to the center, and the lower metal line includes a first lower metal line crossing the upper metal line and disposed to be parallel with another adjacent first lower metal line, and a second lower metal line disposed to be parallel with the upper metal line.

3 Claims, 3 Drawing Sheets

SPIRAL INDUCTOR HAVING PARALLEL-BRANCH STRUCTURE

BACKGROUND OF THE INVENTION

1. Field of the Invention

The present invention relates to an inductor used in a semiconductor integrated circuit (IC), and more particularly, to a spiral inductor having a parallel-branch structure.

2. Description of the Related Art

FIG. 1 is a perspective view showing an example of a conventional spiral inductor and FIG. 2 is a plan view of the conventional spiral inductor shown in FIG. 1.

Referring to FIGS. 1 and 2, the spiral inductor 100 includes a first metal line 110 and a second metal line 120. Although not shown, the first and second metal lines 110 and 120 are vertically spaced apart from each other by an insulating layer (not shown) and are connected to each other by a via contact 130 passing through the insulating layer. The second metal line 120 disposed over the insulating layer spirally turns inward from the outer periphery to the center.

Since there is no inductance between the first and second metal lines 110 and 120 in the above-described spiral inductor 100, the number, shape and size of the second metal line 120 must be changed in order to increase the overall inductance. In this case, however, an increase in the size of the inductor is resulted, reducing the overall integration level. Also, when the inductor has a predetermined area or greater, the overall inductance is not increased any longer due to an increase in the parasitic capacitance between the inductor and the underlying substrate. Also, the quality (Q) factor of the inductor is sharply decreased due to parasitic capacitance components with respect to the substrate of the first and second metal lines 110 and 120, which makes it impossible for the inductor to function properly. Further, the maximum Q factor of the inductor is not generated at a desired frequency but is generated at a predetermined frequency.

FIG. 3 is a perspective view showing another example of a conventional spiral inductor and FIG. 4 is a plan view of the conventional spiral inductor shown in FIG. 3.

Referring to FIGS. 3 and 4, a spiral inductor 200 includes a first metal line 210 and a second metal line 220 vertically spaced apart from each other by an insulating layer (not shown). The first and second metal lines 210 and 220 are connected to each other through a via contact 230. Here, at least two first metal lines 210 connected to the via contact 230 are disposed to be parallel. Thus, in addition to the inductance due to the second metal line 220, mutual conductance between the parallel first metal lines 210 is also generated, thereby increasing the overall inductance. Also, a decrease in the overall area of the first metal lines 210 reduces a parasitic capacitance between the inductor and the underlying substrate, leading to an increase in Q-factor. In addition, symmetric arrangement of metal lines facilitates an architecture work of a circuit.

In this case, however, although the overall capacitance is rather increased, the increment in capacitance is negligible. Also, the maximum Q factor is still exhibited at a specific frequency rather than a desired frequency.

Further, various methods of increasing the cross-sectional areas of metal lines have been proposed, including, for example, making a metal line thicker by further providing the plating step, making a three-dimensional shape using bonding wires, forming multiple-layer metal lines of 3 or more layers to then connect the second and third metal lines through many via contacts, and so on. These methods have several manufacturing disadvantages, for example, a lack in reproducibility, a lack in compatibility with silicon based semiconductor processes, an increase in manufacturing cost, a prolonged manufacturing time and so on.

SUMMARY OF THE INVENTION

To solve the above-described problems, it is an object of the present invention to provide a spiral inductor having a parallel-branch structure which can be controlled to generate the maximum Q-factor at a desired frequency while increasing the overall inductance and Q-factor without increasing the area occupied by metal lines.

To accomplish the above object, there is provided a spiral inductor having a lower metal line and an upper metal line with an insulating layer interposed therebetween, the lower and upper metal lines being connected to each other through a via contact passing through the insulating layer, wherein the upper metal line spirally turns inward from the periphery to the center, and the lower metal line includes a first lower metal line crossing the upper metal line and disposed to be parallel with another adjacent first lower metal line, and a second lower metal line disposed to be parallel with the upper metal line.

Preferably, the first lower metal line is relatively shorter than the second lower metal line.

The upper and lower metal lines may be electrically parallel connected to each other through the via contact.

The area of the lower metal line is preferably determined by a predetermined frequency at which the maximum Q-factor is exhibited.

BRIEF DESCRIPTION OF THE DRAWINGS

The above object and advantages of the present invention will become more apparent by describing in detail a preferred embodiment thereof with reference to the attached drawings in which.

DETAILED DESCRIPTION OF THE INVENTION

The present invention will now be described more fully hereinafter with reference to the accompanying drawings, in which a preferred embodiment of the invention is shown. The present invention may, however, be embodied in different forms and should not be construed as limited to the embodiment set forth herein.

Figure 1:
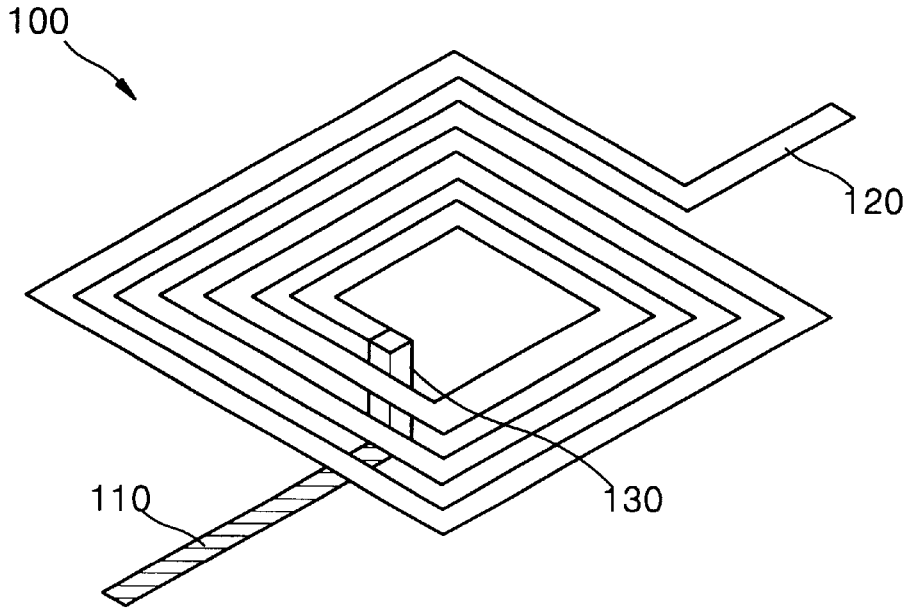
FIG. 1 (PRIOR ART)
FIG. 1 is a perspective view of a conventional spiral inductor.
Figure 2:
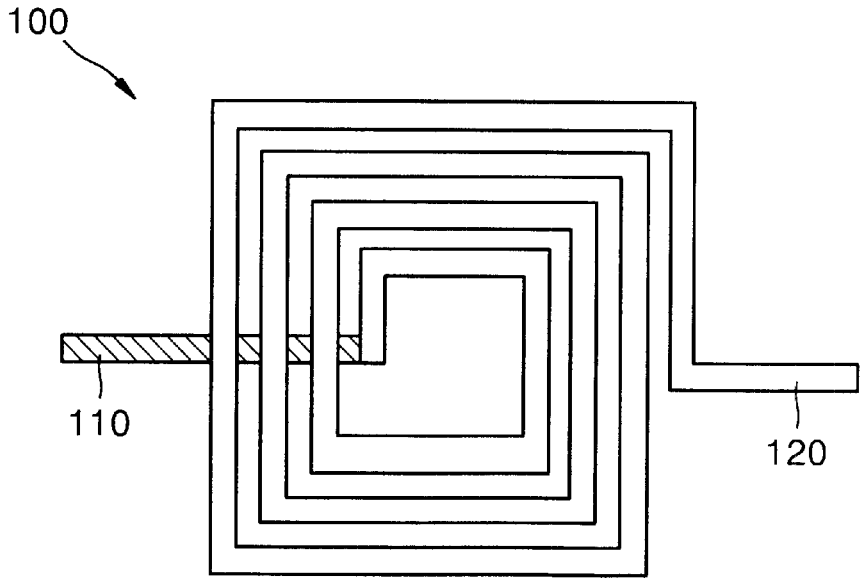
FIG. 2 (PRIOR ART)
FIG. 2 is a plan view of the conventional spiral inductor shown in FIG. 1.
Figure 3:
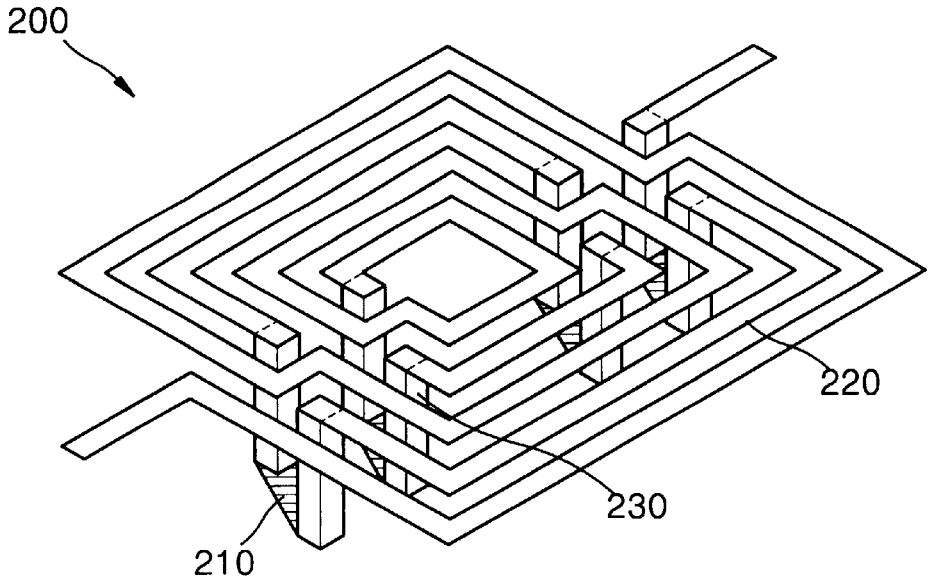
FIG. 3 (PRIOR ART)
FIG. 3 is a perspective view of another conventional spiral inductor.
Figure 4:
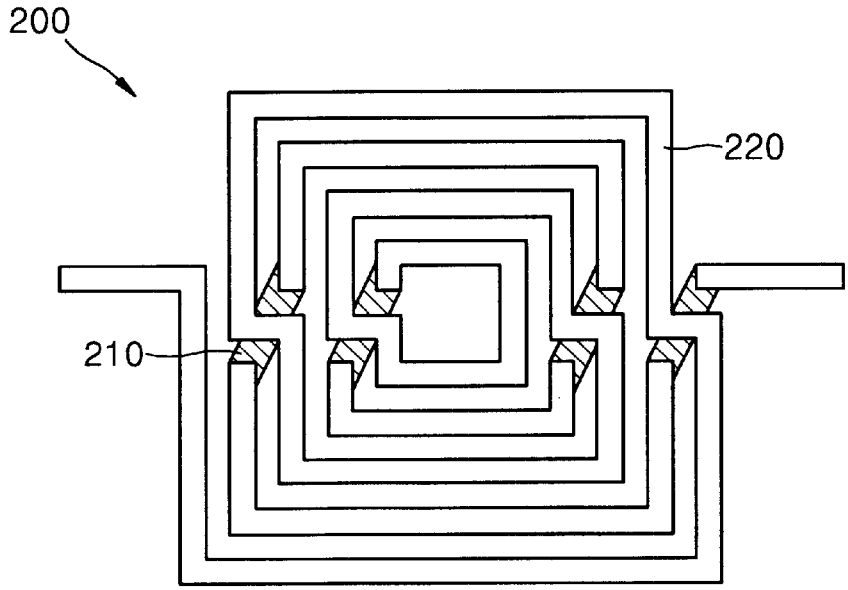
FIG. 4 (PRIOR ART)
FIG. 4 is a plan view of the conventional spiral inductor shown in FIG. 3.
Figure 5:
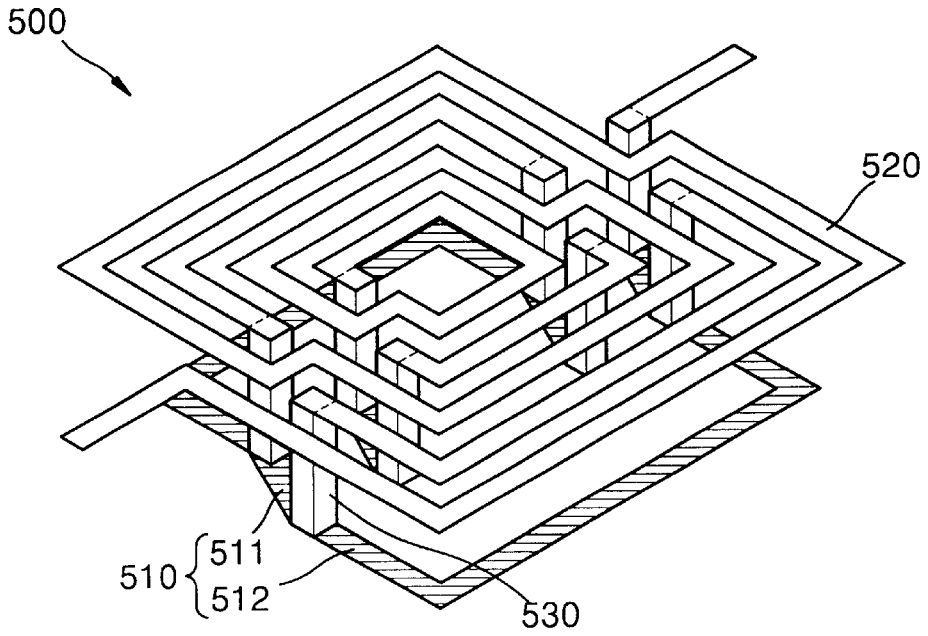
FIG. 5 is a perspective view of a spiral inductor having a parallel-branch structure according to the present invention.
Figure 6:
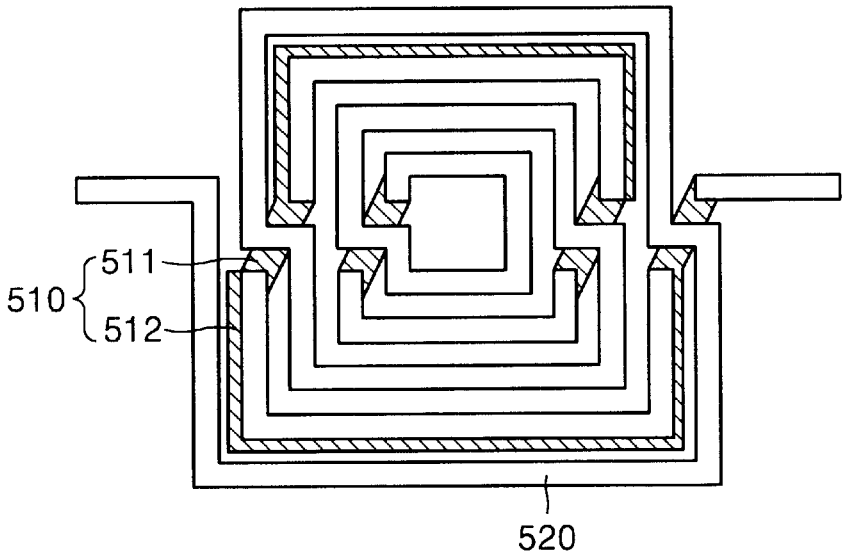
FIG. 6 is a plan view of the spiral inductor shown in FIG. 5.

FIG. 5 is a perspective view of a spiral inductor having a parallel-branch structure according to the present invention, and FIG. 6 is a plan view of the spiral inductor shown in FIG. 5.

Referring to FIGS. 5 and 6, a spiral inductor 500 according to the present invention includes a lower metal line 510 and an upper metal line 520. The lower and upper metal lines 510 and 520 are disposed so as to be vertically spaced apart from each other by an insulating layer (not shown) and to be electrically connected to each other through a via contact 530. Here, the lower metal line 510 and the upper metal 520 are electrically parallel connected to each other.

The upper metal line 520 is spirally wound inward from the periphery to the center. The spiral upper metal line 520 may have various shapes such as rectangle, circle or other polygons.

The lower metal line 510 includes a first lower metal line 511 and a second lower metal line 512. The first lower metal line 511 crossing the upper metal line 520 is disposed to be parallel with another adjacent first lower metal line 511, and the second lower metal line 512 is disposed to be parallel with the upper metal line 520. The second lower metal line 512 is not perfectly parallel with the upper metal line 520 and may be disposed so that a current flow direction is at an acute angle of less than 90° with respect to the upper metal line 520. The first lower metal line 511 is shorter than the second lower metal line 512.

The overall inductance of the above-described spiral inductor is the sum of a self inductance of the upper metal line 520, a mutual inductance between adjacent first lower metal lines 511 and a mutual inductance between the upper metal line 520 and the second lower metal line 512 disposed in parallel. Thus, according to the preset invention, the Q-factor increasing in proportion to the overall inductance increases, in contrast with the conventional case. Since the upper metal line 520 and the lower metal line 510 are electrically parallel connected, metal line resistance is greatly reduced at a parallel-branch portion, thereby compensating for a parasitic capacitance between the lower metal line 510 and a substrate (not shown) and a reduction in Q-factor. Also, the parasitic capacitance caused by the lower metal line 510 can be adjusted by adjusting the area where the second lower metal line 512 and the upper metal line 520 are parallel to each other. Thus, the frequency band at which the maximum Q-factor, which is inversely proportional to the resistance and capacitance, is exhibited, can be adjusted to a desired frequency band. In some cases, the frequency band can be adjusted by adjusting the line width, length and interval of the lower metal line 510 instead of the area.

As described above, in the spiral inductor having a parallel-branch structure according to the present invention, some lower metal lines are disposed to be parallel to each other and the other lower metal lines are disposed to be parallel to an upper metal line to generate a mutual inductance between the lower metal lines and a mutual inductance between the lower metal lines and the upper metal line, thereby increasing the overall inductance, leading to an increase in the Q-factor. Also, a frequency band at which the maximum Q-factor is exhibited can be arbitrarily determined adjusted by adjusting the area occupied by the lower metal lines and the upper metal line which are disposed parallel to each other.

What is claimed is:

1. A Spiral inductor comprising:

a plurality of upper metal lines spirally turning inward from the periphery to the center;

a plurality of lower metal lines;

an insulating layer interposed between the plurality of upper metal lines and the plurality of lower metal lines; and a via contact passing through the insulating layer, wherein the via contact connects the plurality of upper metal lines with the plurality of lower metal lines;

wherein the plurality of lower metal lines include first lower metal lines crossing the plurality of upper metal lines and second lower metal lines overlapping with the plurality of upper metal lines, and the plurality of upper metal lines and the plurality of lower metal lines constructs an electric circuit in which the plurality of upper metal lines are connected to be parallel with the plurality of lower metal lines.

2. The spiral inductor according to claim 1, wherein the first lower metal lines are shorter than the second lower metal lines.

3. The spiral inductor according to claim 1, wherein the overlapping area of the plurality of upper metal lines and the second lower metal lines is determined by a predetermined frequency at which a desirable Q-factor can be acquired.

* * * * *